United States Patent [19]

Elson et al.

[11] Patent Number: 4,841,594

[45] Date of Patent: Jun. 27, 1989

[54] CORDLESS VACUUM CLEANER WITH POWER BRUSH

[75] Inventors: Donald E. Elson, Baltimore, Md.; Burton E. Gerke, Jr., Newtown, Conn.; Michael E. Bitzel, Monroe, Conn.; Bruce A. Wilder, Clinton, Conn.; Stanley J. Rodowsky, Jr., Baltimore, Md.; William R. Lessig, III, Hunt Valley, Md.; Jeffrey S. Adams, Baltimore, Md.; Todd A. Hagan, Hampstead, Md.

[73] Assignee: Black & Decker, Inc., Newark, Del.

[21] Appl. No.: 929,103

[22] Filed: Nov. 7, 1986

[51] Int. Cl.[4] ..... A47L 5/26

[52] U.S. Cl. ..... 15/344; 15/338; 15/350; 15/377; 15/391

[58] Field of Search ..... 15/344, 377, 338, 350, 15/351, 328, 414, 389, 391

[56] References Cited

U.S. PATENT DOCUMENTS

| | | | |
|---|---|---|---|
| 2,592,710 | 4/1952 | Kirby | 15/414 X |
| 3,005,224 | 10/1961 | Magarian | 15/391 X |
| 3,039,129 | 6/1962 | Belicka et al. | 15/377 X |
| 3,608,333 | 9/1971 | Selley et al. | 15/389 X |
| 4,173,809 | 11/1979 | Ku | 15/340 X |
| 4,573,237 | 3/1986 | Kochte et al. | 15/344 |
| 4,685,171 | 8/1987 | Beaudoin | 15/391 |

FOREIGN PATENT DOCUMENTS

| | | | |
|---|---|---|---|
| 1288752 | 2/1962 | France | 15/391 |
| 990065 | 4/1965 | United Kingdom | 15/344 |

*Primary Examiner*—Chris K. Moore

*Attorney, Agent, or Firm*—Paul J. Lerner

[57] ABSTRACT

A cordless vacuum cleaner includes provision for snap-on attachment of a power brush to a rigid dust bowl thereof. Cooperating electrical contacts in the power brush and the dust bowl connect a brush motor in the power brush for concerted operation with a vacuum cleaner motor in the cordless vacuum cleaner. Cooperating latch members in the dust bowl and the power brush enable snapping the two elements together and facilitate their separation. Clam-shell construction is utilized to accept parts of the latch members and a contact retainer suppporting both electrical contacts for application of power from the cordless vacuum cleaner to the power brush. An integrated base provides means for retaining both the cordless vacuum cleaner and the power brush attachment.

13 Claims, 9 Drawing Sheets

FIG. 2
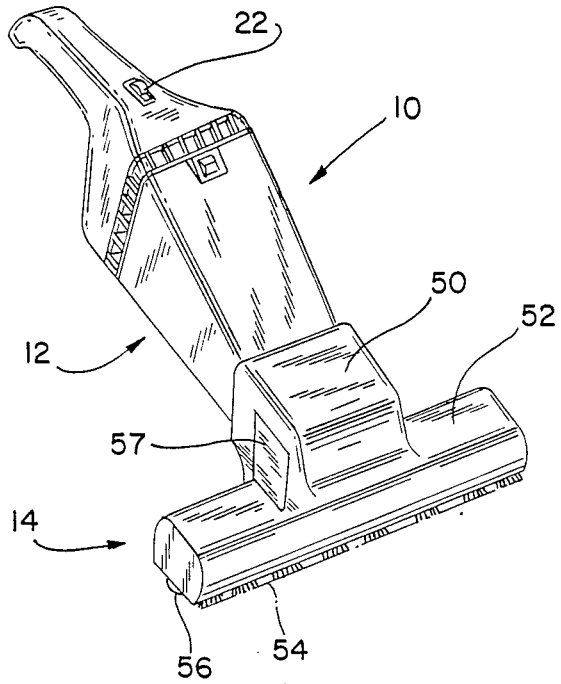
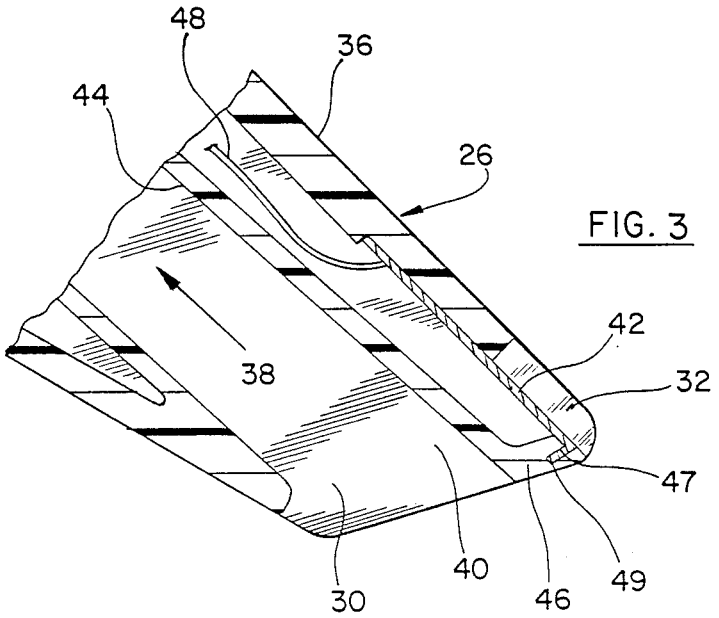
FIG. 3

CORDLESS VACUUM CLEANER WITH POWER BRUSH

BACKGROUND OF THE INVENTION

The present invention relates to housewares and, more particularly, to vacuum cleaners.

Vacuum cleaners are almost indispensable houseware appliances for household cleaning. Such cleaners are most commonly powered by AC power from an external source. Generally, they consist of a fan or blower operative to produce a partial vacuum at an intake. Air sucked in by the partial vacuum passes through a filter bag, whereby dirt particles are removed from the air stream. The filtered air is returned to the environment.

Pure-vacuum cleaners, such as described above, are most suited to removing dust, dirt and hair from hard surfaces such as, for example, wood or tile. Dust, dirt and hair found on a carpet or fabric may adhere so strongly thereto that a vacuum-only cleaner may be incapable of satisfactory cleaning. Conventional vacuum cleaners meet this additional problem with a rotating cylindrical brush contacting the surface being cleaned. The brush tends to dislodge dust, dirt and hair which is thereupon entrained in the air stream created by the partial vacuum. Once moving in the air stream, the dust, dirt and hair is filtered from the air stream by the filter bag.

The above externally powered vacuum cleaners tend to be large and heavy. Thus, certain types of cleaning which is adapted to vacuum cleaning is not conveniently performed with them. In addition, the need for an external power source limits their use to areas where such external power sources are available.

A relatively new class of vacuum cleaner solves the problems of size, weight and power availability. Such a new class, disclosed in U.S. Pat. No. 4,209,875, is exemplified by a cordless, hand-held vacuum cleaner sold under the trademark Dust Buster by the Black and Decker Corporation. The cordless condition is achieved by an internal rechargeable battery in the vacuum cleaner capable of being recharged between uses.

As conventionally appearing, the above cordless vacuum cleaner is a vacuum-only device. The problems of dirt adherence to fabric surfaces is even more severe with a battery-driven device than with an externally powered cleaner due to the reduced power obtainable from internal rechargeable batteries. Thus, although this device overcomes the size, weight and power-source problems, its use is somewhat restricted to cleaning hard surfaces or material loosely lying on fabric surfaces.

One solution to this problem is found in a fixed, stiff-bristled brush which may be removably inserted adjacent the inlet of a vacuum cleaner. Entangled dirt, etc., is loosened with the fixed brush and the loosened material is entrained in the air stream for removal in the filter bag.

OBJECTS AND SUMMARY OF THE INVENTION

Accordingly, it is an object of the invention to provide a vacuum cleaner which overcomes the drawbacks of the prior art.

It is a further object of the invention to provide a cordless vacuum cleaner having a power brush at its intake for loosening material to be removed from a substrate.

It is a still further object of the invention to provide a cordless vacuum cleaner having a removable power brush attachment. The cordless vacuum cleaner and the power brush attachment including mutually cooperating means for automatically providing power to a brush motor.

It is a still further object of the invention to provide a cordless vacuum cleaner having a removable power brush attachment. The power brush attachment includes an electric motor powered by operation of a power switch on the cordless vacuum cleaner.

It is a still further object of the invention to provide a cordless vacuum cleaner with a power brush, wherein the power brush is snapped onto the intake opening of the cordless vacuum cleaner. Power connections to the power brush are made automatically during attachment thereof to the vacuum cleaner, whereby concerted operation of the vacuum cleaner and the power brush from a single operating switch are enabled.

Briefly stated, the present invention provides a cordless vacuum cleaner having provision for snap-on attachment of a power brush to a rigid dust bowl thereof. Cooperating electrical contacts in the power brush and the dust bowl connect a brush motor in the power brush for concerted operation with a vacuum cleaner motor in the cordless vacuum cleaner. Cooperating latch members in the dust bowl and the power brush enable snapping the two elements together and facilitate their separation. Clam-shell construction is utilized to accept parts of the latch members and a contact retainer supporting both electrical contacts for application of power from the cordless vacuum cleaner to the power brush. An integrated base provides means for retaining both the cordless vacuum cleaner and the power brush attachment.

According to an embodiment of the invention, there is provided a cordless vacuum cleaner and power brush comprising: a power unit, a vacuum cleaner motor in the power unit, a generally rigid dust bowl sealably affixable to the power unit, an air inlet opening at an end of the dust bowl remote from its attachment to the power unit, a power brush attachment, means for agitating a surface in the power brush attachment, means for permitting the means for agitating to contact the surface, an electric motor in the power brush attachment, connecting means for removably connecting the power brush attachment to the power unit wherein the air inlet opening is positioned in a predetermined position with respect to the means for permitting the means for agitating to contact the surface, the connecting means including means for rigid connection, cooperating electrical connection means for connecting the electric motor for concerted operation with the vacuum cleaner motor, drive means for driving the means for agitating by the electric motor, a cordless source of electric power, and means for applying electric power from the cordless source concertedly to the vacuum cleaner motor and the electric motor.

The above, and other objects, features and advantages of the present invention will become apparent from the following description read in conjunction with the accompanying drawings, in which like reference numerals designate the sam elements.

BRIEF DESCRIPTION OF THE DRAWINGS

FIG. 2 is a perspective view of the cordless vacuum cleaner with power brush attachment of FIG. 1 with the separable elements attached.

FIG. 3 is a cross section taken along III—III in FIG. 1.

DETAILED DESCRIPTION OF THE PREFERRED EMBODIMENT

Figure 1:
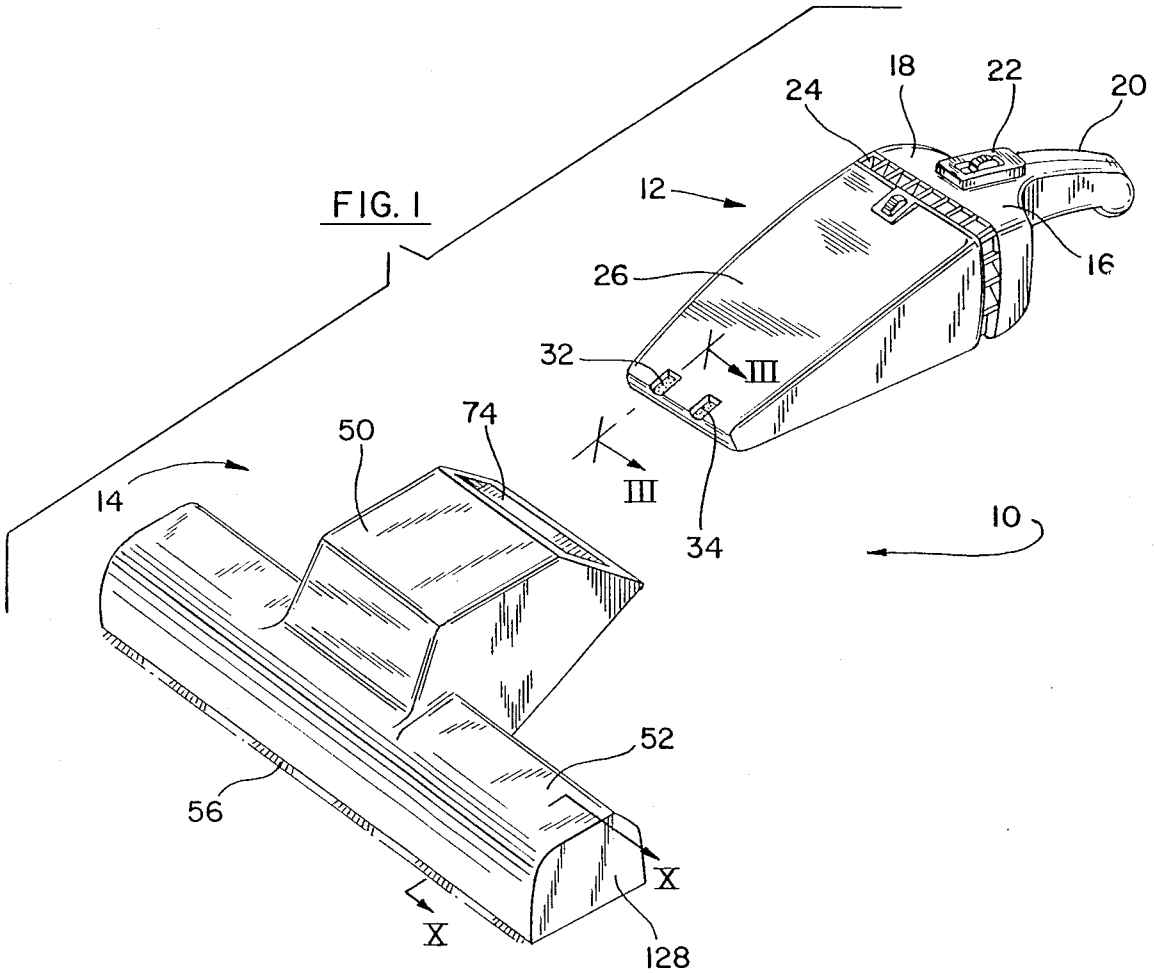
FIG. 1 is a perspective view of a cordless vacuum cleaner with power brush attachment according to an embodiment of the invention, with the separable elements shown detached.

Referring to FIG. 1, there is shown, generally at 10, a cordless vacuum cleaner with a power brush attachment according to an embodiment of the invention. It will be recognized that the precise shape and size of cordless vacuum cleaner with power brush 10 is selected for concreteness of description and that other shapes and sizes of cordless vacuum cleaner with power brush 10 may be adapted to the present invention without departing from the spirit and scope thereof.

Cordless vacuum cleaner with power brush 10 includes a cordless vacuum cleaner 12 and a power brush attachment 14 shown separated from each other in FIG. 1. Referring momentarily to FIG. 2, as will be more fully detailed hereinafter, cordless vacuum cleaner 12 and power brush attachment 14 are connectable together to form a single rigid unit.

Returning now to FIG. 1, cordless vacuum cleaner 12 includes a power unit 16 having a body 18 to which a handle 20 is affixed. In the device of the referenced patent, the disclosure of which is herein incorporated by reference, handle 20 contains rechargeable batteries (not shown). A power switch 22 is disposed on body 18 in a position making it accessible to a person holding cordless vacuum cleaner 12 by handle 20. Power switch 22 is conveniently a spring-loaded switch normally biased into the OFF condition and urged to the ON position by pressure of the user's thumb or finger. Actuation of power switch 22 operates an internal motor driving a fan (not shown) within body 18. A set of louvers 24 about the perimeter of body 18 permit exit of air driven by the internal fan.

A dust bowl 26 snaps sealingly onto the forward end of body 18 where it is retained by a spring latch 28. An air inlet opening 30 at a forward end of dust bowl 26 permits the entry of air, and entrained dirt, into dust bowl 26. A filter (not shown) inside dust bowl 26 retains the dirt within dust bowl 26 while the air is discharged through louvers 24. First and second contact notches 32 and 34 are disposed in an upper surface 36 of dust bowl 26 adjacent air inlet opening 30.

Referring now to FIG. 3, an internal nozzle 38 defines an air flow passage 40, only a portion of which is shown, leading into dust bowl 26. A metallic contact 42 is disposed adjacent an external surface 44 of integral nozzle 38 within contact notch 32. A sealing wall 46 extends upward from external surface 44 toward metallic contact 42. A bent end portion 47 on metallic contact 42 is fitted into a slot 49 of sealing wall 46 to stabilize metallic contact 42 and to prevent a bypass flow of air into dust bowl 26. An electrical conductor 48 provides electrical communication between metallic contact 42 and power switch 22 (FIGS. 1 and 2).

Contact notch 34 is identical to contact notch 32 and thus is not further detailed. It is preferred that at least one electrical path to metallic contact 42 in contact notch 32 or contact notch 34 is insulated in its internal path through dust bowl 26 in order to avoid accidental short circuiting of power when dust bowl 26 contains metallic objects such as, for example, steel wool, staples, and the like. Making electrical conductor 48 of wire having insulation thereon is satisfactory. In one embodiment, electrical conductor 48 is replaced by a flat ribbon of metal (not shown) which may be, for example, a continuation of metallic contact 42 passing internally through dust bowl 26. At least one, and preferably both of such flat ribbons of metal are covered with an insulating material such as, for example, a plastic layer (not shown). The plastic layer may be, for example, a plastic sleeve, slipped over the metallic ribbon before final assembly. Alternatively, the plastic layer may be coated as a liquid onto the metallic ribbon and cured in place to form the required coating of insulating material.

Referring again also to FIGS. 1 and 2 electrical conductors 48 from contact notches 32 and 34 are connected to power switch 22 and to the internal batteries (not shown) in handle 20 by any convenient means. In one embodiment of the invention, electrical conductors 48 are connected directly to the elements in body 18. A service loop (not shown) in electrical conductors 48 permits removal of dust bowl 26 from body 18 for emptying dirt. In a further embodiment, electrical connections between dust bowl 26 and body 18 are made by electrical contacts between these elements which are resiliently engaged by the act of attaching dust bowl 26 to body 18. In the referenced patent, a pair of openings in the bottom of dust bowl 26 are entered by a mating pair of projections for assisting in the stable attachment of dust bowl 26 to body 18. In the present invention, electrical contacts (not shown) aligned with the openings and projections are employed to provide the desired automatic electrical connection when dust bowl 26 is affixed to body 18.

Power brush attachment 14 includes a motor cover 50 integrally formed with a brush housing 52. Motor cover 50 and brush housing 52 may be made of any convenient material, but are preferably made of a molded plastic material such as, for example, polypropylene. A brush opening 54 extends across substantially the entire width of brush housing 52 to reveal a cylindrical brush 56. An access door 57 in motor cover 50 (FIG. 2) provides access for attaching an internal belt (not shown in FIG. 2) and for cleaning a belt drive mechanism, to be more fully detailed hereinafter.

Figure 4:
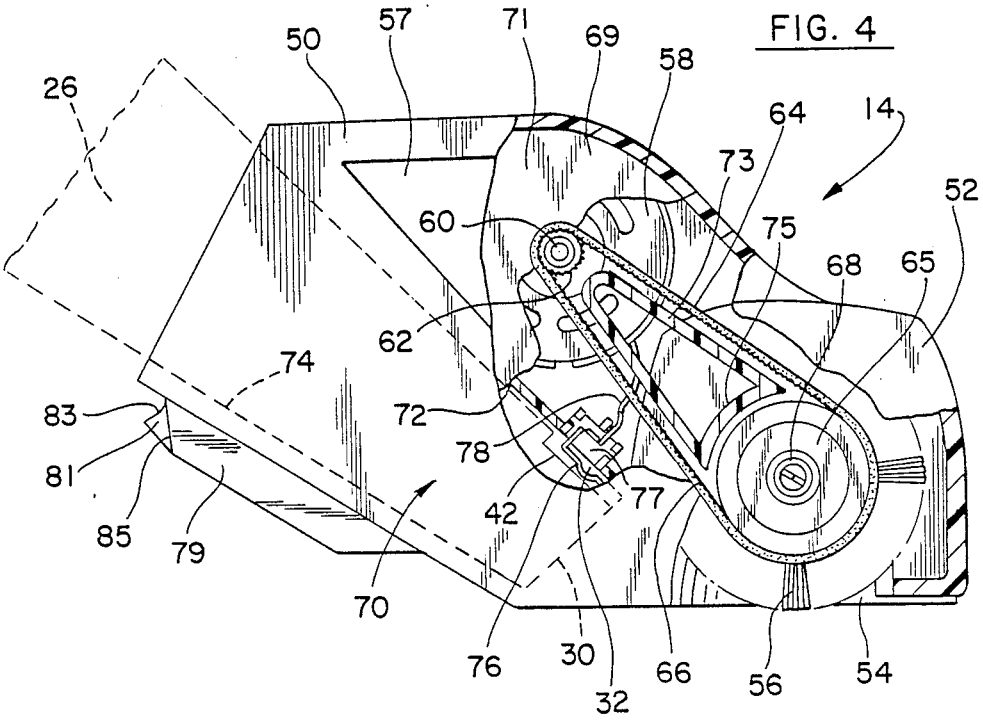
FIG. 4 is a side view, partly cut away, of the power brush attachment of FIGS. 1 and 2.
Figure 5:
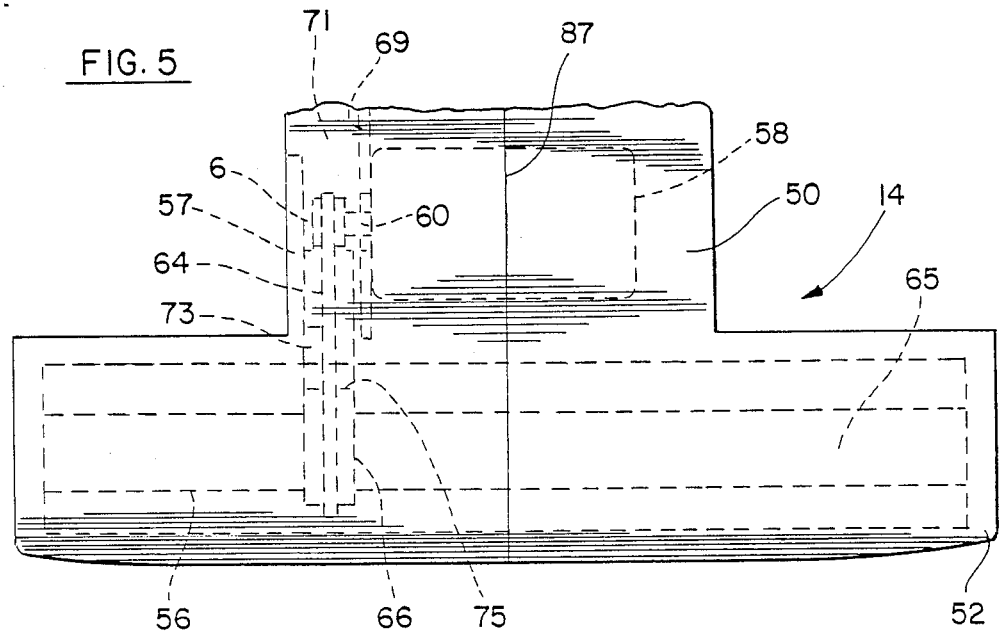
FIG. 5 is a top view of the power brush attachment of FIGS. 1 and 2 with the location of major internal components indicated in dashed lines.

Referring now to FIGS. 4 and 5, an electric motor 58 in motor cover 50 includes a motor shaft 60 having a toothed pulley 62 thereon. A flexible toothed drive belt 64 passes over toothed pulley 62 and over a toothed band 66 on cylindrical brush 56. A shaft 68 passing through a brush spindle 65 of cylindrical brush 56 rotatably supports cylindrical brush 56, whereby cylindrical brush 56 may be concertedly driven by electric motor 58. An inner wall 69 between electric motor 58 and flexible toothed drive belt 64 forms a drive belt chamber 71 for isolating dirt and contaminants loosened by power brush attachment 14 from entry into electric motor 58 wherein they may cause damage. A belt guide 73, preferably integrally formed on an inside surface of access door 57, is disposed within the run of flexible toothed drive belt 64 between toothed pulley 62 and toothed band 66. A curved dirt-stripper portion 75 on belt guide 73 is disposed closely adjacent toothed band 66. Curved dirt-stripper portion 75 has a curvature substantially matching the curvature of toothed band 66. The close proximity of curved dirt-stripper portion 75 to toothed band 66 strips larger particles of dirt from toothed band 66 and/or flexible toothed drive belt 64 before they are carried into drive belt chamber 71 wherein they could interfere with free operation of power brush attachment 14. When access door 57 is removed, belt guide 73, removed with it, clears drive belt chamber 71 to enable cleaning of dirt from drive belt chamber 71 or reeving of flexible toothed drive belt 64 onto motor shaft 60.

An attachment portion 70 of motor cover 50 includes an opening having an upper wall 72 and a lower wall 74 spaced and angled to embrace a forward portion of dust bowl 26, shown in dashed line. When dust bowl 26 is seated in attachment portion 70, air inlet opening 30 thereof is positioned at brush opening 54 just behind cylindrical brush 56. Rotation of cylindrical brush 56 in the clockwise direction in FIG. 4 tends to agitate a surface being cleaned and to hurl loosened dirt toward and into air inlet opening 30, as is desired.

It would be clear to one skilled in the art that alternative means for providing agitation of the surface being cleaned could be substituted for cylindrical brush 56 without departing from the spirit and scope of the invention.

A pair of electrical contacts 76 (only one of which is shown) are supported on opposed ends of a contact retainer 77 to enter contact notches 32 and 34 (only contact notch 32 is shown) into contact with respective metallic contacts 42 therein. Each metallic contact 42 is connected to a respective electrical conductor 78 leading to electric motor 58. Thus, insertion of dust bowl 26 into attachment portion 70 completes electrical contact between these elements.

Instead of employing automatic connection of power to electric motor 58 as shown and described, an embodiment of the invention is contemplated wherein electrical connection is completed manually using, for example, a conventional electrical plug attached to one of the elements and a conventional mating socket attached to the other (neither of which is shown). The plug and/or socket may be optionally attached using a pendant cord (not shown).

A latch compartment 79, whose internal structure is detailed later, depends from a lower surface of attachment portion 70. A latch tang 81, having a camming surface 83 thereon, is centered transversely in a rear surface 85 of latch compartment 79.

As best seen in FIG. 5, the placement of internal components in power brush attachment 14 is indicated in dashed lines. Balance is important in a hand-held device. Electric motor 58 represents a significant concentrated weight in power brush attachment 14 which, if offset to one side, would upset the desired balance. Electric motor 58 therefore is centered in the overall width of power brush attachment 14. Cylindrical brush 56 extends a substantial distance beyond the ends of electric motor 58. Toothed band 66 is disposed on brush spindle 65 spaced inward from the end thereof for engagement with flexible toothed drive belt 64 running directly to it from motor shaft 60.

Although not necessary to the broadest concept of the invention, power brush attachment 14 is preferably formed of mating halves joined at a mating line 87. Such clam-shell construction facilitates efficient assembly of internal parts by rapid manual, drop-in techniques. Specific advantage is taken of this construction in elements of the present invention as will be disclosed hereinafter.

Figure 6:
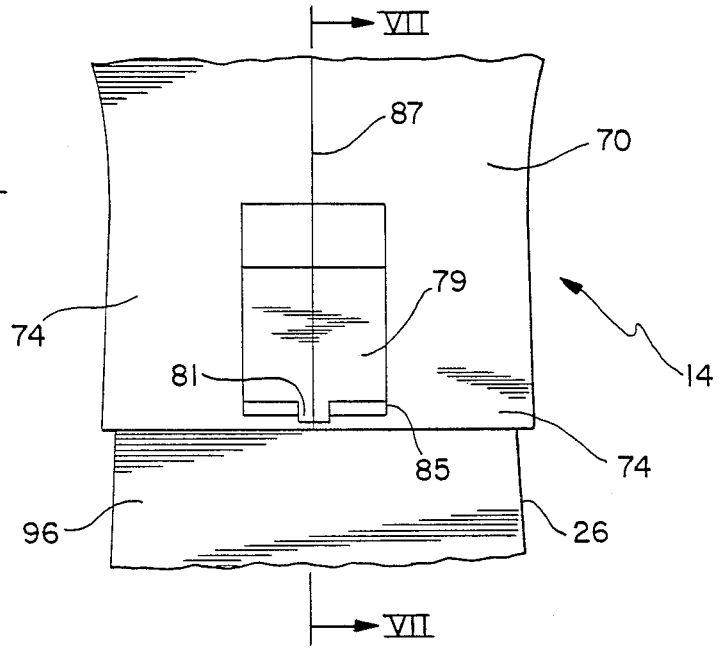
FIG. 6 is a bottom view of a portion of a cordless vacuum cleaner with power brush attachment showing the latch member for retaining the separable members in the connected condition.
Figure 7:
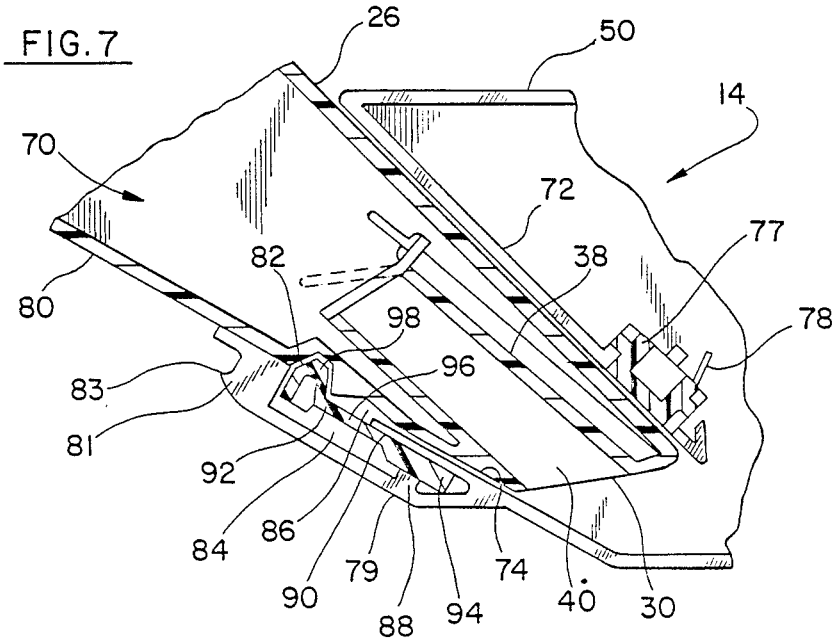
FIG. 7 is a cross section taken along VII—VII in FIG. 6.

Referring now to FIGS. 6 and 7, a lower surface 80 of dust bowl 26 includes a camming surface 83 molded therein. Latch compartment 79 includes a pocket 84 having an opening 86 facing lower surface 80 of dust bowl 26, when in the assembled condition illustrated. A retainer boss 88 is spaced from a facing surface 90 adjacent opening 86. A latch bar 92 includes a thickened clamping portion 94 sized for an interference fit between retainer boss 88 and 90. A resilient cantilevered portion 96 connects thickened clamping portion 94 to a latch cam 98 extending through opening 86.

It will be noted that motor cover 50 contains surface shading since the illustrated view is taken at mating line 87 (FIG. 6), whereas latch bar 92 is hatched, indicating a cross section. Mating line 87 is assembled by slipping it into pocket 84 with thickened clamping portion 94 being gripped between retainer boss 88 and facing surface 90. An end of latch bar 92 protrudes from the plane of the page for capture in a corresponding portion of pocket 84 in the other mating half of power brush attachment 14. This permits placing latch bar 92 in position in one half of power brush attachment 14 with its entry into the other half of power brush attachment 14 being accomplished when the two halves of power brush attachment 14 are mated. One or more convenient locating devices (not shown) may be provided for retaining latch bar 92 in the longitudinal direction. For example, a groove (not shown) may be formed in each end of thickened clamping portion 94 and a mating boss (also not shown) may be molded into the halves of pocket 84. Since such retention devices are conventional and well known in the art, further description and illustration thereof is properly omitted.

Power brush attachment 14 is affixed to dust bowl 26 by sliding attachment portion 70 into the opening in motor cover 50. Resilient cantilevered portion 96 provides sufficient resilience to permit latch cam 98 to be depressed during insertion until latch cam 98 enters transverse locking notch 82. Thereafter, springback of resilient cantilevered portion 96 resiliently urges latch cam 98 into the mated position shown in transverse locking notch 82. The cooperating shapes of transverse locking notch 82 and latch cam 98, combined with the resilient urging applied to latch cam 98 tends to retain the mated condition against reasonable force urging them apart. During removal, sufficient force is applied to power brush attachment 14 and dust bowl 26 to cam latch cam 98 downward while pulling power brush attachment 14 of dust bowl 26.

Contact retainer 77 is also hatched indicating that similar drop-in assembly techniques are employed for this element as well.

Figure 8:
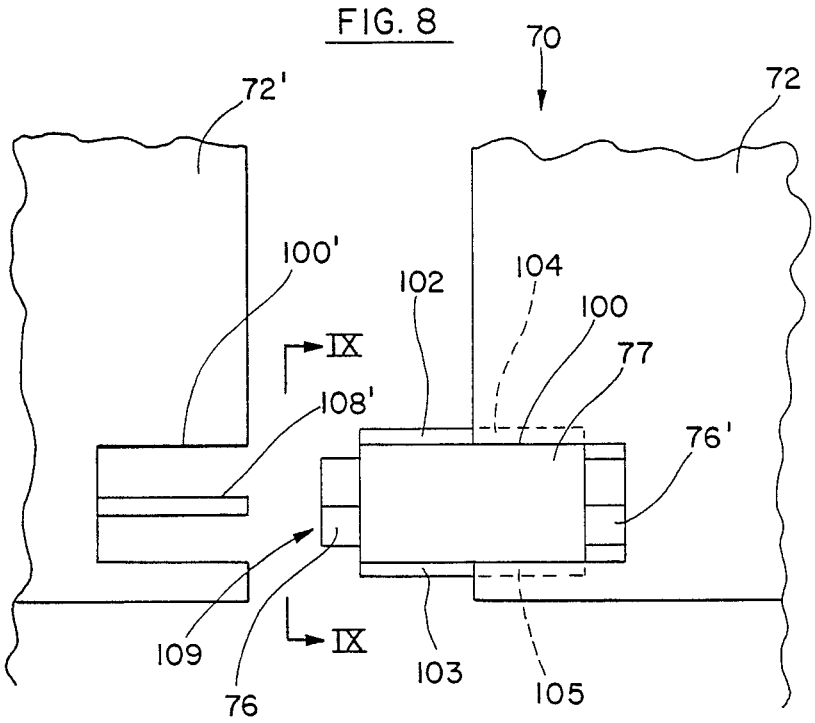
FIG. 8 is a view taken inside a portion of the power brake attachment looking toward upper wall halves separated to illustrate the manner in which a contact retainer is installed.
Figure 9:
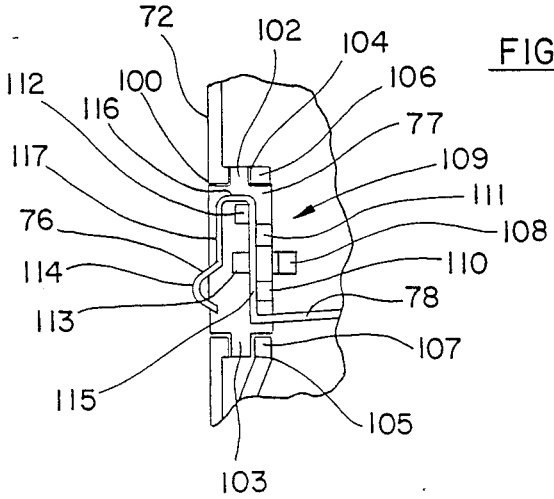
FIG. 9 is a view taken in a direction IX—IX in FIG. 8.

Referring now to FIGS. 8 and 9, wherein corresponding elements are indicated by reference numeral and primed reference numeral, upper wall halves 72 and 72' include facing slots 100 and 100', respectively. Where elements in upper wall 72' are not specifically discussed, it may be assumed that they are mirror images of corresponding elements in upper wall 72. First and second tongues 102 and 103 extend transversely from contact retainer 77 into grooves 104 and 105, respectively, in upper wall 72. As best seen in FIG. 9, groove 104 is formed by an inner surface of upper wall 72 and a rib 106 molded at a position spaced therefrom a distance appropriate to accommodate tongue 102. Similarly, groove 105 is formed by the inner surface of upper wall 72 and a further rib 107. A central rib 108 is centered in slot 100 and spaced inward therefrom a distance effective to contact a rear surface of contact retainer 77 near its center.

A nest 109 is formed at each end of contact retainer 77 by a plurality of bosses 110, 111, 112 and 113 relatively positioned to retain electrical contact 76 firmly and to permit resilient deflection of a contact portion 114 thereof. Electrical contact 76 is preferably a formed flat strip of a resilient metal such as, for example, beryllium bronze. A straight clamping run 115 of electrical contact 76 is connected a one end to electrical conductor 78 and passes between bosses 110 and 111 abutting one surface thereof and bosses 112 and 113 abutting the opposed surface thereof. It will be noted that bosses 110, 111, 112 and 113 are spaced apart longitudinally and staggered transversely so that boss 112, contacting one surface of straight clamping run 115, faces a gap between bosses 110 and 111 contacting the opposed surface thereof. The transverse spacing between planes of surfaces contacting the opposed surfaces of straight clamping run 115 may be slightly less than the thickness of straight clamping run 115. Similarly, boss 111 faces a gap between bosses 112 and 113 and these elements have a corresponding spacing between the planes of contact too narrow to permit passage of straight clamping run 115 therethrough without deforming straight clamping run 115 slightly from its straight run.

An end turn 116 is connected from an end of straight clamping run 115 to an end of a return run 117 spaced outward from bosses 112 and 113. Contact portion 114 is connected to the other end of return run 117.

It will be recognized from FIG. 8 that the center-to-center spacing of electrical contacts 76 and 76', and their positions with respect to upper wall halves 72 and 72', are fully determined by contact retainer 77. The act of positioning one end of contact retainer 77 in slot 100, and inserting the other end into slot 100' when the two halves of upper wall halves 72 and 72' are mated takes care of all required alignment of electrical contacts 76 and 76'.

Figure 10:
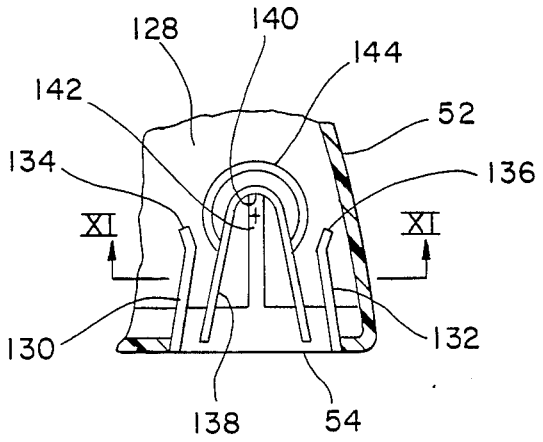
FIG. 10 is a view inside the brush housing of FIG. 1 looking toward one end thereof with intervening elements removed for purposes of illustration.
Figure 11:
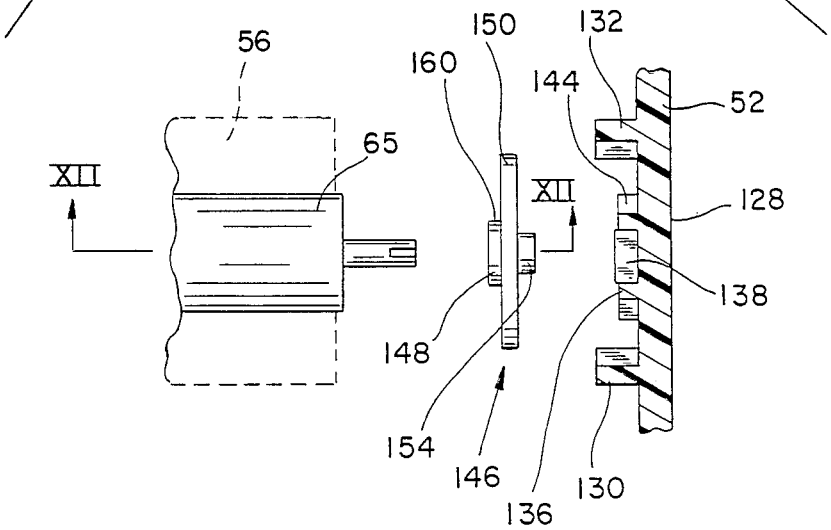
FIG. 11 is a cross section taken along XI—XI in FIG. 10 with additional elements added in exploded form to shown relationships to which reference will be made in describing the invention.

Referring now to FIG. 10, an inside view of brush housing 52 is shown looking toward an end 128 thereof. Cylindrical brush 56, and other elements are removed in this view for clarity of illustration. Reference should also be made to FIG. 11 during the following description. It will be understood that a mirror image of the apparatus illustrated and described is disposed in the other end of motor cover 50 but, since the shape and function of such mirror image will be fully understood from the following description, it will not be described.

First and second retainer arms 130 and 132, integrally molded with end 128, are angled slightly toward each other. An upper end of retainer arm 130 terminates in an outwardly angled portion 134. Similarly, an upper end of retainer arm 132 terminates in an outwardly angled portion 126. A hairpin-shaped hub guide 138, integrally molded with end 128, terminates in a part-circular hub retainer 140. Part-circular hub retainer 140 has a center 142 indicated by a + symbol. A center 142, disposed outside part-circular hub retainer 140, has its center co-located with a center of part-circular back-up rib 144. It will be noted that center 142 is located upward beyond the closest approach of retainer arms 130 and 132. Also, retainer arms 130 and 132 extend further outward from end 128 than do outwardly angled portion 136 and 144.

Figure 12:
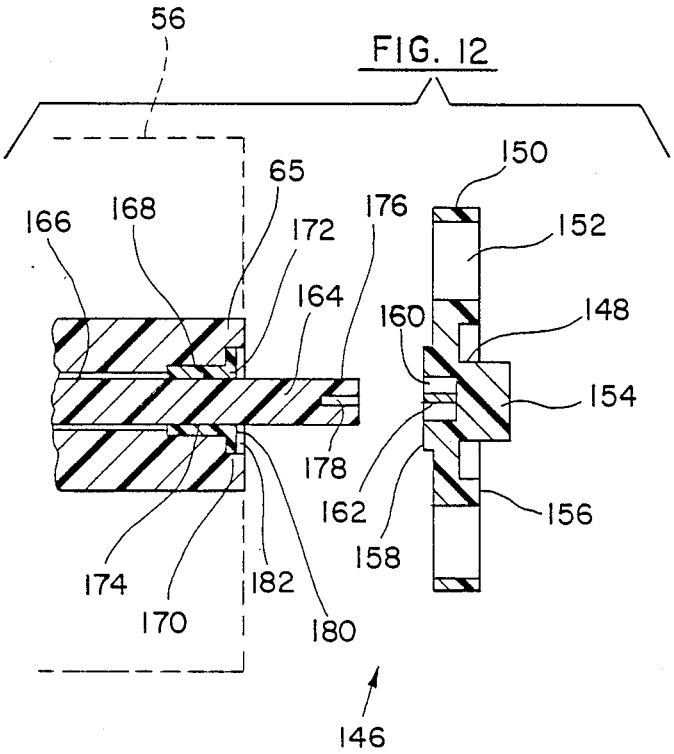
FIG. 12 is a cross section taken along XII—XII in FIG. 11.
Figure 13:
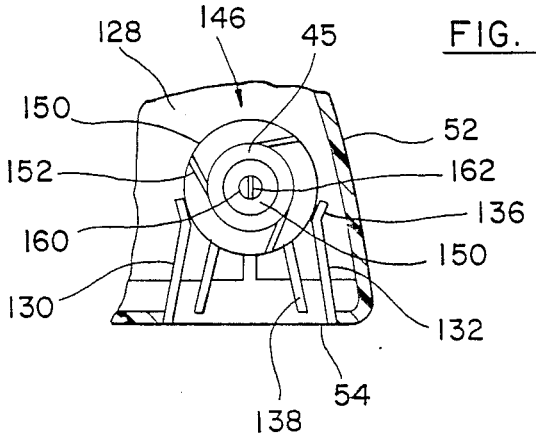
FIG. 13 is a view corresponding to FIG. 10 with a flex-rim wheel installed in its stable position but with other intervening elements removed for illustration.

Referring now also to FIGS. 12 and 13, a flex-rim wheel 146 includes a central disk 148 and a thin, flexible rim 150. A plurality of spokes 152 (best seen in FIG. 13) extend diagonally from a perimeter of central disk 148 to retain spoke 152 in a concentric position. Preferably, a small number of spokes, preferably three, is combined with a thin cross section in rim 150 in order to provide substantial deformability in rim 150.

Central disk 148 includes a hub 154 protruding toward end 128 (FIG. 11). A ring 156, concentric with hub 154, is disposed at a radius substantially equal to a radius of part-circular back-up rib 144 (FIGS. 10 and 11). At the side opposite to that containing hub 154, central disk 148 includes a guide disk 158 having a blind hole 160 centered therein. A septum 162 spans the diameter of blind hole 160.

Referring specifically now to FIG. 12, a guide rod 164 passes loosely through an axial bore 166 in brush spindle 65. First and second counterbores 168 and 170 in each end of brush spindle 65 (only one end is shown) accommodate a bushing 172. An axial bore 174 permits guide rod 164 to pass therethrough and facilitates relative rotation therebetween. An end portion 176 of guide rod 164 is sized for insertion into blind hole 160 with a slot 178 fitting onto septum 162. A flange 180 on bushing 172 is recessed within counterbore 170 to provide an annular guide recess 182 having a diameter to accept guide disk 158 of flex-rim wheel 146 therein when the elements in FIG. 12 are fitted together in their operational positions.

Referring as necessary to FIGS. 10–13, to install cylindrical brush 56 in brush housing 52, a flex-rim wheel 146 is placed on each end of guide rod 164. In this condition, and portion 176 at each end of guide rod 164 are inserted into their respective blind hole 160. The lengths of brush spindle 65 and guide rod 164 are such that this positioning places guide disk 158 of each flex-rim wheel 146 abutting ends of brush spindle 65. In one embodiment, in the described condition, each guide disk 158 guidingly enters its respective annular guide recess 182.

The lengths of brush spindle 65 and guide rod 164 are also effective to position both flex-rim wheels 146 at axial locations wherein ring 156 on each is disposed for abutment with inner surfaces of outwardly angled portion 136 and part-circular back-up rib 144. Hub 154 on each flex-rim wheel 146 extends between legs of hair-pin-shaped hub guide 138. Brush spindle 65 is installed by pressing each flex-rim wheel 146 upward until it locks in place with hub 154 resting against part-circular hub retainer 140 with the axis of hub 154 co-located with center 142 (FIG. 10). An outside diameter of rim 150 is greater than the distance between retainer arms 130 and 132 at their closest approach. Rim 150 is deflected resiliently inward as it moves over-center past the point of closest approach and then expands slightly into stable contact with outwardly angled portions 134 and 136. The small number of spokes 152, and their diagonal orientation, contributes to the required resiliency of rim 150. A sufficient amount of resilient deformation of rim 150 is maintained in the stable position to prevent rotation of flex-rim wheel 146 during operation of power brush attachment 14. Engagement between septum 162 and slot 178 at each end of guide rod 164 retains guide rod 164 in the non-rotating condition. Thus, rotation is constrained to cylindrical brush 56 with a bushing 172 contacting guide rod 164 near each end of cylindrical brush 56.

In the commercial realization of the prior-art battery-operated vacuum cleaner, it is conventional to provide an integrated base and charger assembly for storing the vacuum cleaner, for containing an AC-to-DC converter and for applying the DC for charging the internal battery when the vacuum cleaner is mounted in the integrated base and charger assembly. To the extent that such apparatus appears in the prior art, it is considered to provide only an environment within which the present improvement is disclosed.

Figure 14:
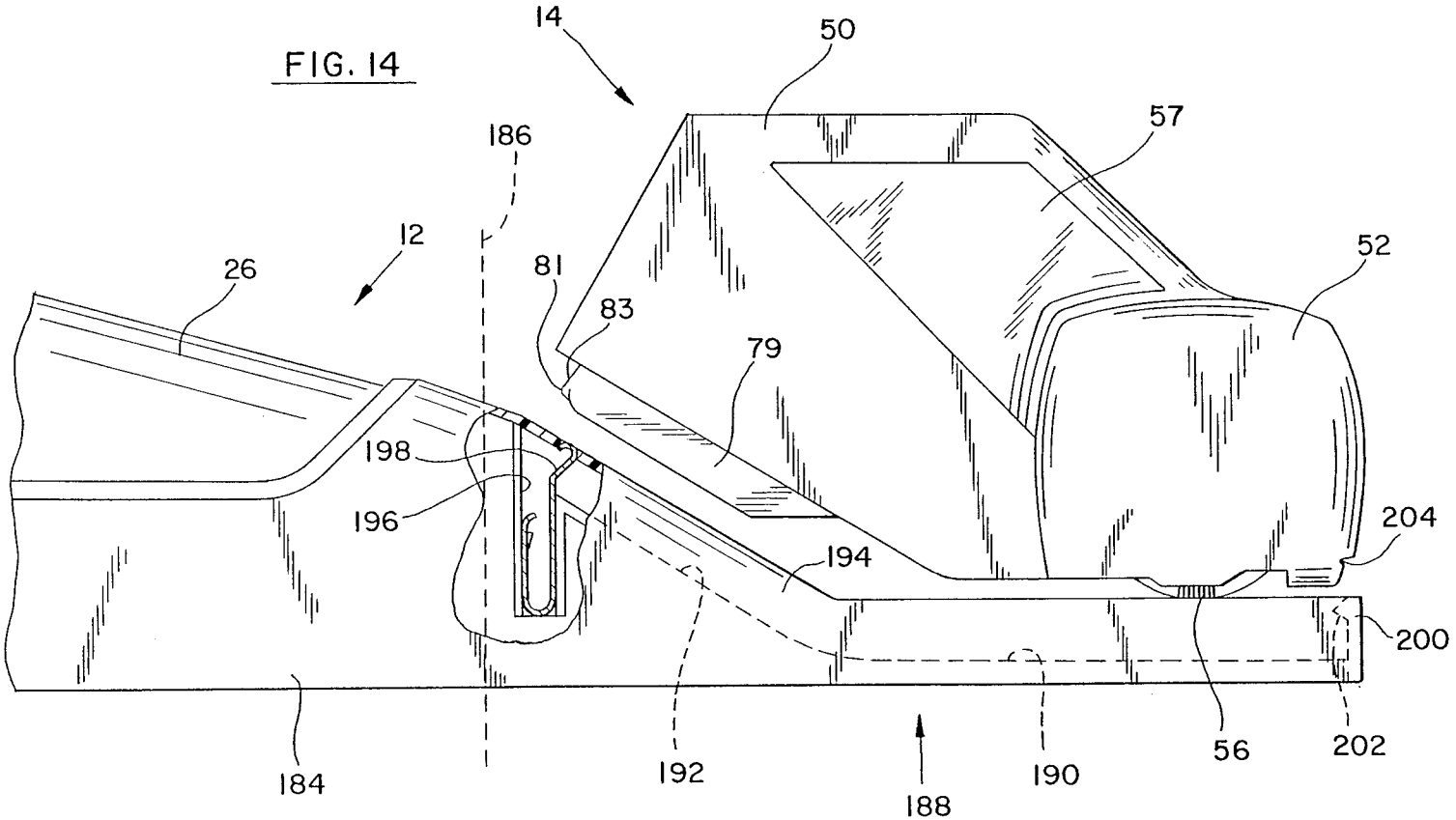
FIG. 14 is a side view of significant portions of an integrated base for containing a cordless vacuum cleaner and a power brush attachment.

Referring now to FIG. 14, an integrated base 184 includes means for storing cordless vacuum cleaner 12 and power brush attachment 14. For present purposes, it may be considered that elements to the left of a vertical dashed line 186 correspond generally to a vacuum-cleaner base of the prior art and may contain an AC-to-DC converter with the necessary cooperating interface elements between it and cordless vacuum cleaner 12 for charging the internal batteries therein. Elements to the left of vertical dashed line 186, being conventional, do not require further detailed description for a full understanding by one skilled in the art.

To the right of vertical dashed line 186, a power brush base assembly 188 includes a horizontal floor 190 and a sloped floor 192 within a perimeter wall 194 generally sized, shaped and angled to accept and support a bottom of power brush attachment 14 therein.

A pocket 196 in power brush base assembly 188 retains a resilient latch member 198 extending upward beyond sloped floor 192. A front wall 200 of perimeter wall 194 includes an inward-pointing protuberance 202. A depression 204 which may be, for example, part of a decorative trim of brush housing 52, is positioned for engagement with inward-pointing protuberance 202.

To mount power brush attachment 14 in power brush base assembly 188, the right end of power brush attachment 14 is tilted downward while depression 204 is moved into engagement with inward-pointing protuberance 202. Then the left end of power brush attachment 14 is lowered until latch tang 81 deflects resilient latch member 198 and thereafter resilient latch member 198 is resiliently urged into stable retaining contact with camming surface 83.

Figure 15:
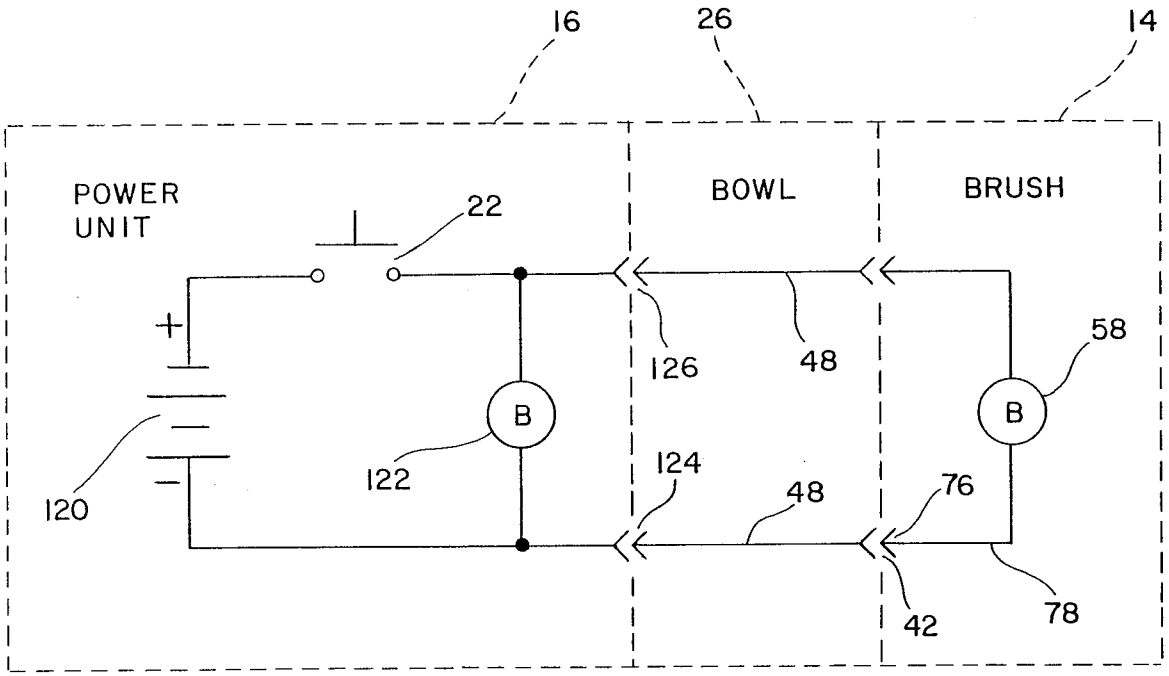
FIG. 15 is an electrical schematic diagram of the cordless vacuum cleaner with power brush of the present invention.

Referring now to FIG. 15, power unit 16 includes a battery 120 having one of its terminals permanently connected to one terminal of a vacuum cleaner motor 122. The other terminal of battery 120 is connected to one terminal of power switch 22. The other terminal of power switch 22 is connected to a second terminal of vacuum cleaner motor 122. First and second connectors 124 and 126 connect electrical conductors 48 in dust bowl 26 to the terminals of vacuum cleaner motor 122. Metallic contacts 42 and electrical contacts 76 connect electrical conductors 48 to electrical conductors 78 in power brush attachment 14. Electrical conductors 78 are, in turn, connected to terminals of electric motor 58. As can be seen, electric motor 58 is effectively connected in parallel with vacuum cleaner motor 122, whereby energizing vacuum cleaner motor 122 by closing power switch 22 also energizes electric motor 58.

It should be understood that the parallel connection of power to electric motor 58 and vacuum cleaner motor 122 upon closure of power switch 22 is not a required limitation. For example, series connection may be desirable in some application. Furthermore, power switch 22 may include means (not shown) for permitting operator selection of parallel and series connection of vacuum cleaner motor 122 and electric motor 58. Applications may be contemplated in which it is desirable to disable one of vacuum cleaner motor 122 and electric motor 58 while the operating the other thereof. For example, it may be desired to operate power brush attachment 14 for dressing a surface without operation of vacuum cleaner motor 122. Suitable modification of power switch 22, in a manner well known to those skilled in the art may be performed to enable operation in such modified ways.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vacuum cleaner comprising:

a power unit;

a vacuum cleaner motor in said power unit;

a generallly rigid dust bowl sealably affixable to said power unit;

an air inlet opening at an end of said dust bowl remote from an end thereof attachable to said power unit;

an attachment;

means for agitating a surface in said attachment;

means for permitting said means for agitating to contact said surface;

an electric motor in said attachment;

connecting means for removably connecting said attachment to said dust bowl;

said connecting means including means for rigid connection;

cooperating electrical connection means for connecting said electric motor for concerted operation with said vacuum cleaner motor;

drive means for driving said means for agitating by said electric motor;

a source of electric power;

said cooperating electrical connecting means means for applying electric power from said source concertedly to said vacuum cleaner motor and said electric motor;

said dust bowl adjacent said air inlet opening includes first and second surfaces mutually disposed at an angle, and said connecting means includes:

an attachment portion in said attachment;

said attachment portion including an upper wall and a lower wall;

said upper wall and said lower wall having an inclination with respect to each other substantially equal to said angle, whereby said dust bowl is fittable into a predetermined position within said attachment portion;

a latch including cooperating latch means on said attachment portion and said dust bowl for detachably retaining said attachment portion on said dust bowl, whereby said rigid connection is attained;

said electrical connection means including first and second electrical contact members on said power unit and third and fourth electrical contact members on said attachment;

means for biasing said first and third electrical contact members together into electrical contact when said connecting means connects said attachment to said dust bowl; and means for biasing said second and fourth electrical contact members together into electrical contact when said connecting means connects attachment to power unit.

2. A vacuum cleaner according to claim 1 wherein said predetermined position is adjacent said means for agitating.

3. A vacuum cleaner according to claim 1 wherein said electric motor is disposed centrally within said attachment, whereby lateral balance is retained.

4. A vacuum cleaner comprising:

a power unit;

a vacuum cleaner motor in said power unit;

a generally rigid dust bowl sealably affixable to said power unit;

an air inlet opening at an end of said dust bowl remote from an end thereof attachable to said power unit;

an attachment;

means for agitating a surface in said attachment;

means for permitting said means for agitating to contact said surface;

an electric motor in said attachment;

connecting means for removably connecting said attachment to said dust bowl;

said connecting means including means for rigid connection;

cooperating electrical connection means for connecting said electric motor for concerted operation with said vacuum cleaner motor;

drive means for driving said means for agitating by said electric motor;

a source of electric power;

said cooperating electrical connecting means including means for applying electric power from said source concertedly to said vacuum cleaner motor and said electric motor;

said means for applying electric power includes first and second electrical connections between said power unit and said dust bowl and third and fourth electrical connections between said dust bowl and said attachment, said first and third electrical connections being connected in series between first terminals of said vacuum cleaner motor and said electric motor, and said second and fourth electrical connections being connected in series between second terminals of said vacuum cleaner motor and said electric motor.

5. A vacuum cleaner according to claim 1 wherein said drive means includes a drive belt.

6. A vacuum cleaner according to claim 6 wherein said means for agitating includes a cylindrical brush and said drive means further includes a toothed drive gear on said electric motor, a toothed band on said cylindrical brush, and a flexible toothed drive belt drivably engaging said toothed drive gear and said toothed band.

7. A vacuum cleaner according to claim 6 wherein said toothed band is displaced a substantial distance inward from an end of said cylindrical brush.

8. A vacuum cleaner comprising:

a power unit;

a vacuum cleaner motor in said power unit;

a generally rigid dust bowl sealably affixable to said power unit;

an air inlet opening at an end of said dust bowl remote from an end thereof attachable to said power unit;

an attachment;

means for agitating a surface in said attachment;

means for permitting said means for agitating to contact said surface;

an electric motor in said attachment;

connecting means for removably connecting said attachment to said dust bowl;

said connecting means including means for rigid connection;

cooperating electrical connection means for connecting said electric motor for concerted operation with said vacuum cleaner motor;

drive means for driving said means for agitating by said electric motor;

a source of electric power;

said cooperating electrical connecting means means for applying electric power from said source concertedly to said vacuum cleaner motor and said electric motor;

said drive means includes a drive belt;

said means for agitating includes a cylindrical brush;

said drive means further includes a pulley on said electric motor;

said drive belt is a drive belt drivably engaging said pulley and said cylindrical brush; and a belt guide disposed within a run of said flexible drive belt between said toothed drive gear and said cylindrical brush.

9. A vacuum cleaner according to claim 8 wherein said belt guide includes a curved dirt-stripper portion adjacent a perimeter of said toothed band.

10. A vacuum cleaner according to claim 1 wherein said means for agitating includes a cylindrical brush, and said drive means includes means for rotating said cylindrical brush.

11. A vacuum cleaner according to claim 1 wherein said cooperating electrical connection means includes automatic means for connecting electric power to said attachment upon employment of said connecting means for connecting said attachment to said power unit when actuated by said means for applying electric power.

12. A vacuum cleaner according to claim 1 wherein said cooperating electrical connection means includes means for connecting said electric motor in parallel with said vacuum cleaner motor for concerted operation by said means for applying electric power.

13. A vacuum cleaner according to claim 1 wherein said source of electric power includes a cordless source of electric power.

* * * * *